US008967679B2

(12) United States Patent
Estrada et al.

(10) Patent No.: US 8,967,679 B2
(45) Date of Patent: Mar. 3, 2015

(54) VEHICLE DOOR LATCH

(75) Inventors: Eduardo Estrada, Ciudad Juarez (MX); Francisco J. Vazquez, Ciudad Juarez (MX); Jorge I. Rodriguez, Ciudad Juarez (MX); David R. Parks, Macomb, MI (US)

(73) Assignee: Inteva Products, LLC, Troy, MI (US)

( * ) Notice: Subject to any disclaimer, the term of this patent is extended or adjusted under 35 U.S.C. 154(b) by 804 days.

(21) Appl. No.: 13/030,030

(22) Filed: Feb. 17, 2011

(65) Prior Publication Data

US 2011/0204659 A1 Aug. 25, 2011

Related U.S. Application Data

(60) Provisional application No. 61/305,795, filed on Feb. 18, 2010.

(51) Int. Cl.
*E05C 3/06* (2006.01)
*E05B 81/14* (2014.01)

(52) U.S. Cl.
CPC *E05B 81/14* (2013.01); *E05B 81/15* (2013.01)
USPC ..... 292/200

(58) Field of Classification Search
USPC ..... 292/201, 200
See application file for complete search history.

(56) References Cited

U.S. PATENT DOCUMENTS 6,079,237 A * 6/2000 Hochart ..... 70/278.6
2007/0029814 A1* 2/2007 Coleman et al. ..... 292/201

* cited by examiner

*Primary Examiner* — Mark Williams
(74) *Attorney, Agent, or Firm* — Cantor Colburn LLP

(57) ABSTRACT

A vehicle door latch assembly is disclosed herein, the vehicle door latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and a engagement surface of the detent lever contacts an engagement surface of the fork bolt; and an actuator for moving the detent lever into the disengaged position from the engaged position, the actuator being configured to prevent the detent lever from moving back to the engaged position until the fork bolt has been moved to the unlatched position.

16 Claims, 5 Drawing Sheets

VEHICLE DOOR LATCH

CROSS REFERENCE TO RELATED APPLICATIONS

This application claims the benefit of U.S. Provisional Patent Application No. 61/305,795 filed Feb. 18, 2010, the contents of which are incorporated herein by reference thereto.

BACKGROUND

Exemplary embodiments of the present invention relate to door and movable panel latches and, more particularly, to door and movable panel latches for vehicles.

A vehicle frequently includes displaceable panels such as doors, hood, trunk lid, hatch and the like which are affixed for hinged or sliding engagement with a host vehicle body. Cooperating systems of latches and strikers are typically provided to ensure that such panels remain secured in their fully closed position when the panel is closed.

A door latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever is spring biased into the engaged position and thus, holds the fork bolt in the primary latched position when in the engaged position and releases the fork bolt when it is moved to the disengaged position so that the door can be opened.

The fork bolt is pivoted to the primary latched position by a striker attached to, for example, an associated door jamb when the door is closed. Once in the primary latched position, the detent lever engages the fork bolt to ensure the assembly remains latched.

Some vehicles have power unlatching mechanisms that electrically release the door latch. These power unlatching mechanisms moves the detent lever from the engaged position to the disengaged position such that the fork bolt can be rotated or pivoted to the unlatched position. However and when an external condition or force is applied to the door the door may not "pop open" freely and if the power unlatching mechanism is subsequently disengaged the detent lever returns to the engaged position by the spring biasing force and the door cannot be opened even though an electric release command was provided.

Accordingly, it is desirable to provide an automatically operated door latch assembly. More specifically, it is desirable to provide an automatically operated door latch assembly that employs a device or motor to move the detent lever from the engaged position to the disengaged position in order to release the striker from the fork bolt.

SUMMARY OF THE INVENTION

In accordance with an exemplary embodiment of the invention, a latch assembly is provided. The latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and a engagement surface of the detent lever contacts an engagement surface of the fork bolt; and an actuator for moving the detent lever into the disengaged position from the engaged position, the actuator being configured to prevent the detent lever from moving back to the engaged position until the fork bolt has been moved to the unlatched position.

In accordance with another exemplary embodiment of the present invention, a method of preventing a detent lever of a vehicle door latch assembly from moving to an engaged position when the detent lever has been moved to a disengaged position by an actuator is provided, the method including the steps of: pivotally securing a fork bolt to the vehicle door latch assembly for movement between an unlatched position and a latched position; pivotally securing the detent lever to the vehicle door latch assembly for movement between the engaged position and a disengaged position wherein a contact surface of the detent lever engages a contact surface of the fork bolt when the detent lever is in the engaged position and the fork bolt is in the latched position; and preventing the detent lever from moving to the engaged position from the disengaged position by restricting the movement of the actuator until the fork bolt has been moved to the unlatched position.

Additional features and advantages of the various aspects of exemplary embodiments of the present invention will become more readily apparent from the following detailed description in conjunction with the drawings wherein like reference numerals refer to corresponding parts in the several views.

Figure 1:
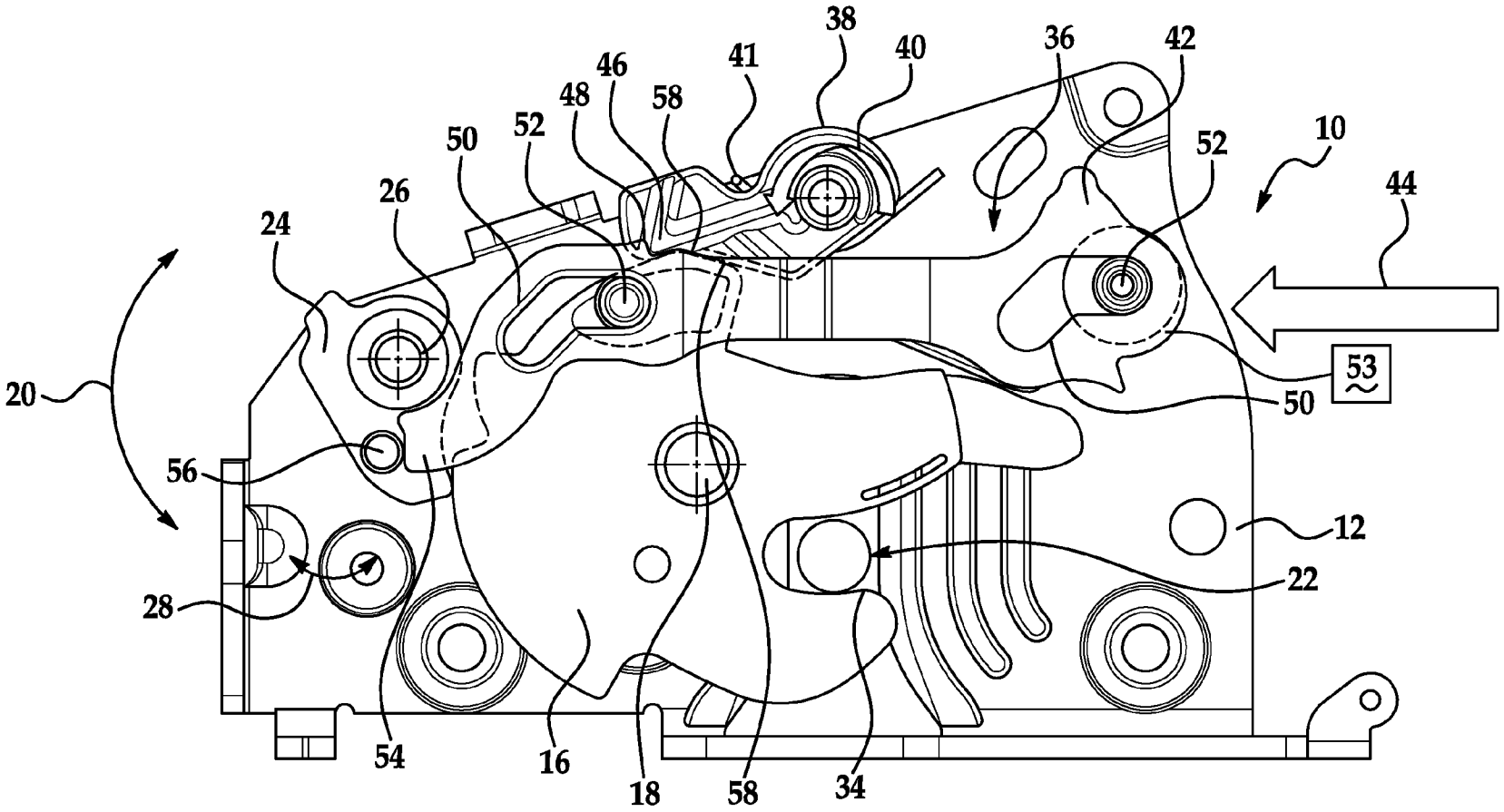
FIG. 1 is a view illustrating a latch assembly in accordance with an exemplary embodiment of the present invention wherein a striker has engaged the fork bolt and has started to rotate the fork bolt from the unlatched position to the latched position.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Exemplary embodiments of the present invention relate to an apparatus and method for providing a latch assembly. Furthermore, exemplary embodiments are directed to a latch assembly having a fork bolt movably secured thereto for movement between a latched position and an unlatched position. The latch assembly further comprises a detent lever capable of movement between an engaged position and a disengaged position, wherein the detent lever retains the fork bolt in the latched position when the detent lever is in the engaged position. The latch assembly also includes an actuator for moving the detent lever from the engaged position to the disengaged position. The actuator further comprises a hold open lever for maintaining the detent lever in the disengaged position until the fork bolt is rotated into the unlatched position.

References made to the following U.S. Pat. Nos. 3,969,789; and 6,568,741 and U.S. Patent Publication No. 2002/0163207 the contents each of which are incorporated herein by reference thereto.

Referring now to FIGS. 1-5, a vehicle compartment latch or latch assembly 10 in accordance with an exemplary embodiment of the present invention is illustrated. As illustrated, the vehicle compartment latch 10 comprises a frame plate or support 12 that is adapted for fastening to a vehicle proximate to a compartment closure.

A fork bolt or fork bolt lever 16 is pivotally or rotationally mounted to frame plate 12 about a pivot pin or stud 18 that is received within a pivot pin opening of the fork bolt. Fork bolt 16 is capable of rotational or pivotal movement between an open or unlatched position and a closed or latched position shown in FIGS. 2-5, wherein the fork bolt rotates in the direction of arrows 20.

Vehicle compartment latch 10 is attached to a vehicle structure such that fork bolt 16 is moved between the open position and the closed position when a door, window, lift gate, etc. is opened and closed and fork bolt 16 engages a striker 22 that is attached to the door, window, lift gate, etc. Alternatively, the vehicle compartment latch 10 is secured to the door, window, lift gate, etc. and the striker is secured to the vehicle body at an opening into which the door, window, lift gate, etc. is received. The cooperation of a fork bolt and striker is well known and need not be described in detail.

Vehicle compartment latch 10 further comprises a detent lever 24 that pivots on support or frame plate 12 about a pivot pin 26 received within a pivot pin opening in the detent lever. The detent lever cooperates with fork bolt 16 in a well known manner to retain fork bolt 16 in the closed position shown in the FIG. 2 or release the fork bolt 16 for return to the open position. That is, detent lever 24 pivots between a closed or engaged detent position shown in the FIGS. and a release or disengaged detent position in the direction of arrows 28. In accordance with an exemplary embodiment of the present invention, fork bolt 16 is spring biased to the open position by a biasing member (e.g., coil spring or other equivalent member) that has one end attached to fork bolt 16 and the other end attached to the housing or other equivalent location. Similarly, a biasing member or spring will also bias the detent lever in the direction of a face of fork bolt 16.

In accordance with exemplary embodiments of the present invention, the fork bolt has an engagement surface or contact surface 30 that slides along and makes contact with a complimentary engagement surface or contact surface 32 of the detent lever when the fork bolt pivots or moves from the open position to the closed position and once in the closed position surface 30 of the fork bolt engages a surface 32 of the detent lever thus engaging the fork bolt and securing it into the closed position when the striker is secured in a receiving opening 34 of the fork bolt. Once the latch is in the closed position the detent lever is spring biased into contact with the fork bolt such that the fork bolt cannot rotate into the open position unless the detent lever is moved back to the release or disengaged detent position (e.g., moving surface 30 away from surface 32 allowing the fork bolt to rotate into the open position).

Figure 2:
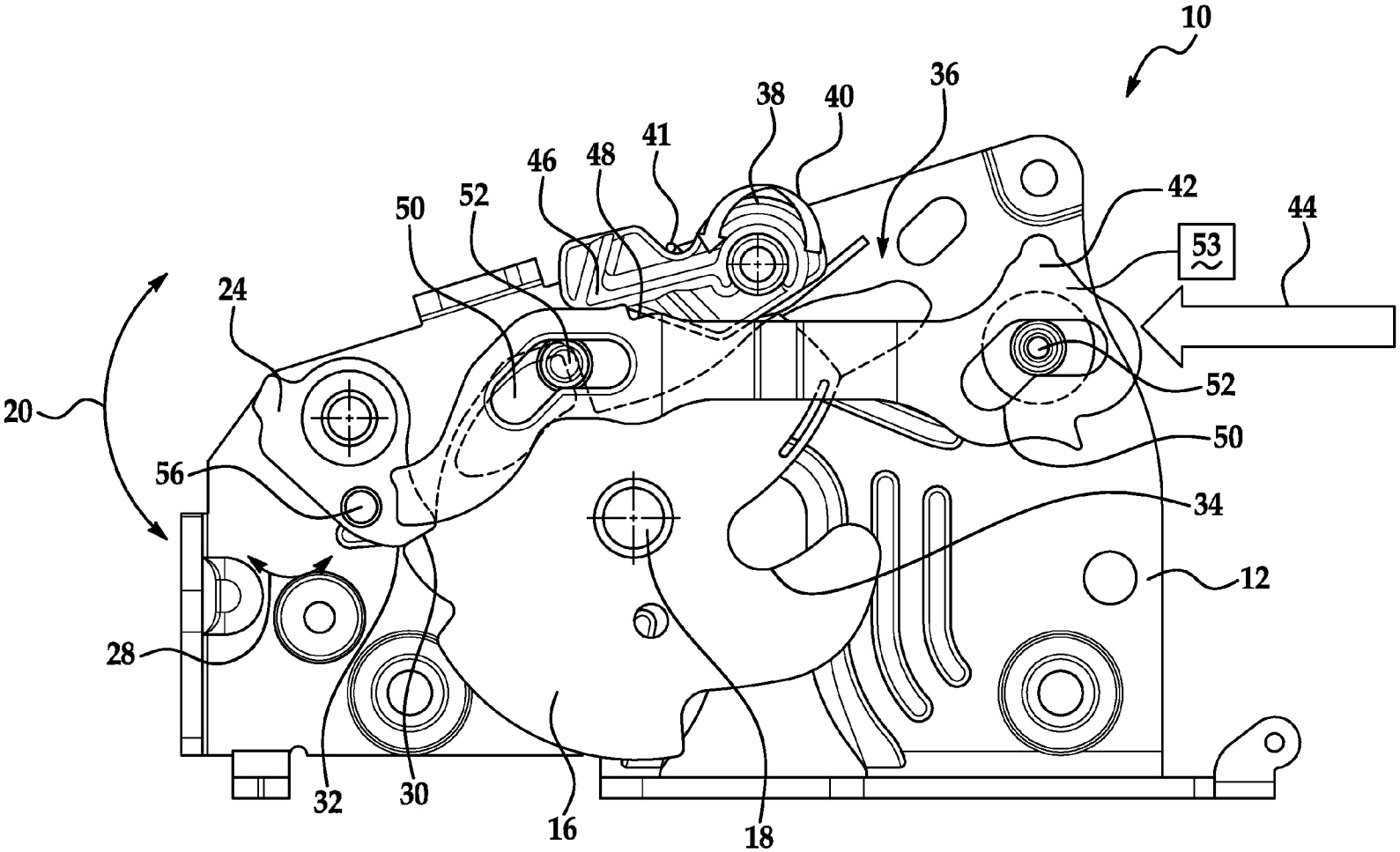
FIG. 2 is a view illustrating the latch assembly of FIG. 1 in a primary or latched position wherein the detent lever has moved to the engaged position.
Figure 3:
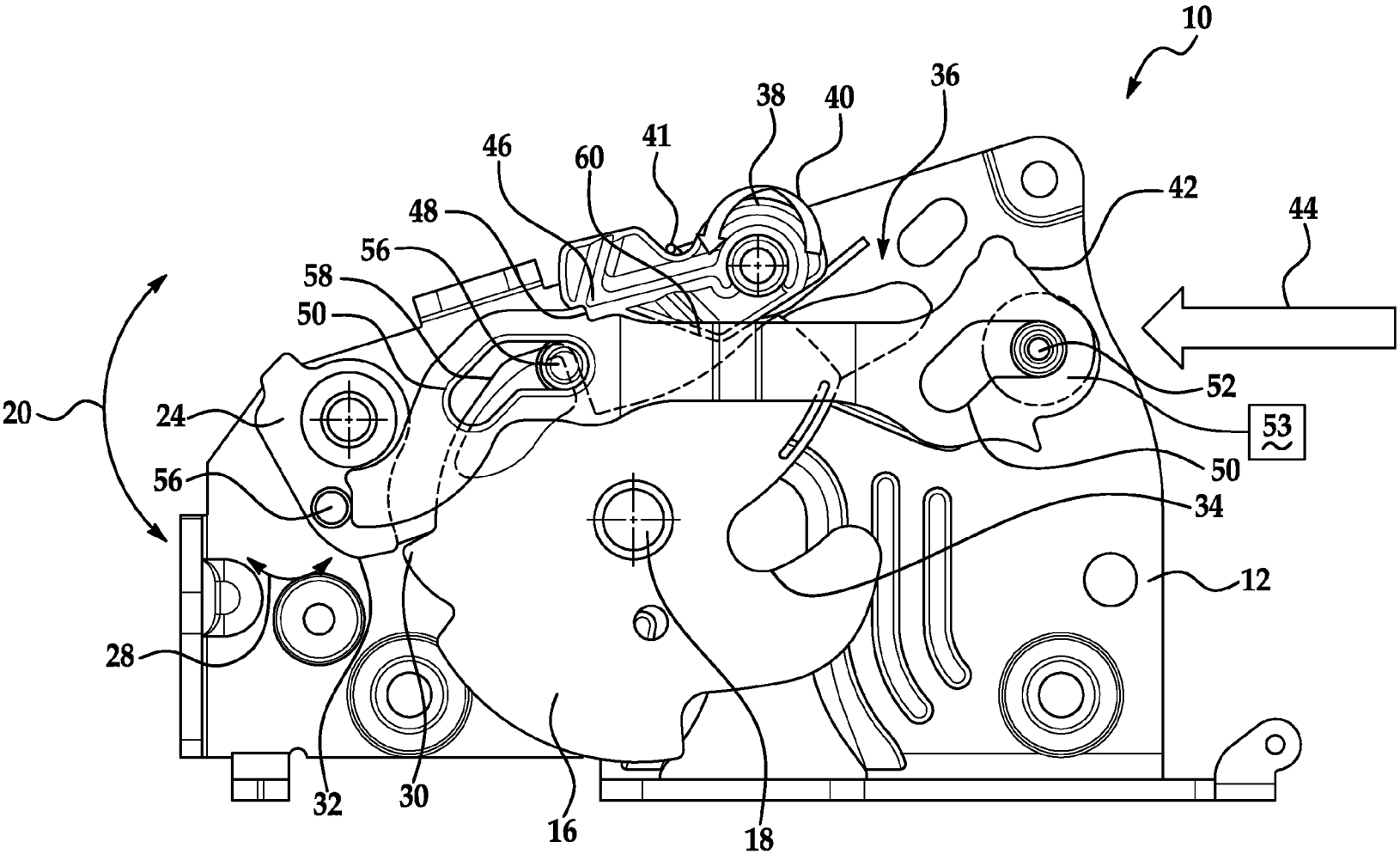
FIGS. 3 and 4 are views illustrating the latch assembly in a primary or latched position wherein the detent lever has been moved to the disengaged position.
Figure 4:
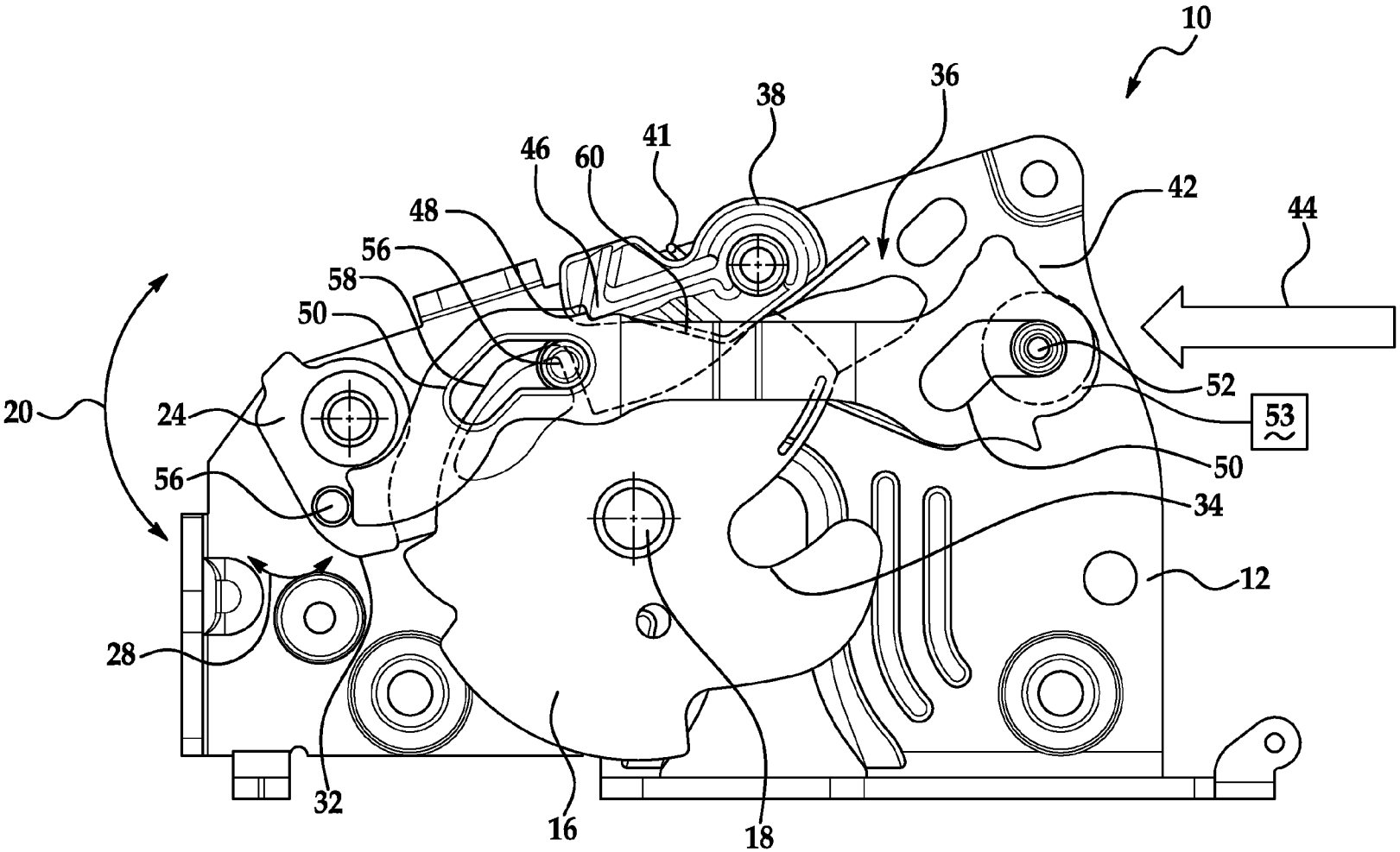

FIGS. 2-4 show structural components of a latch in a fully latched orientation. As seen, the detent lever is engaged on the primary tooth of the fork bolt lever, and each lever is capable of rotating about its respective pivot stud. The pivot studs are dual supported opposite the frame plate by a back plate (not shown).

In order to move the detent lever to the disengaged position, an actuator 36 provides a force to the detent lever in order to rotate it out of engagement with the fork bolt. In one implementation the actuator is electrically operated by a motor 53 illustrated schematically and coupled to the actuator 36 or more particularly the slider 42 by any suitable means, which in this implementation is an electrically powered door opener or actuator that is remotely activated by a signal, which in one non-limiting embodiment is generated or transmitted by a hand held device such as a key fob or other equivalent device. Since the detent lever is spring biased towards the fork bolt the detent lever will return to the engaged position once the force from the actuator is removed.

Accordingly and if the fork bolt has not been rotated to the unlatched position and the force from the remotely activated actuator is removed, the detent lever, which controls the position of the fork bolt lever, is spring biased back into the engaged position and the latch assembly is once again unable to be opened. In order to prevent this the actuator includes a hold open lever 38 that is spring biased in the direction of arrow 40 by a spring 41 such that as a slider 42 of the actuator slides in the direction of arrow 44 in order to move the detent lever into the disengaged position the hold open lever will rotate in the direction of arrow 40 and a portion 46 of the hold open lever will engage a detent or feature 48 of the slider such that the slider will remain in the position illustrated in FIGS. 1 and 4 and thus the detent lever remains in the disengaged position until the fork bolt rotates into the unlatched position.

As shown in the attached FIGS. slider 42 has a pair of slotted openings 50 configured to receive pins or studs 52 and a distal end 54 of the slider is configured to engage a feature 56 of the detent lever in order to rotate the detent lever into the disengaged position when the slider moves in the direction of arrow 44.

Accordingly and when the slider is moved in the direction of arrow 44 end 54 engages feature 56 and the detent lever is rotated to the disengaged position. Thereafter, the hold open lever is then rotated until portion 46 engages detent 48 and the slider is locked or held in the position illustrated in at least FIGS. 1 and 4 wherein the detent lever is maintained in the disengaged position such that if a force is being applied to the door while the detent lever is moved to the disengaged position, the detent lever will remain in this position until the fork bolt is rotated to the unlatched position.

Figure 5:
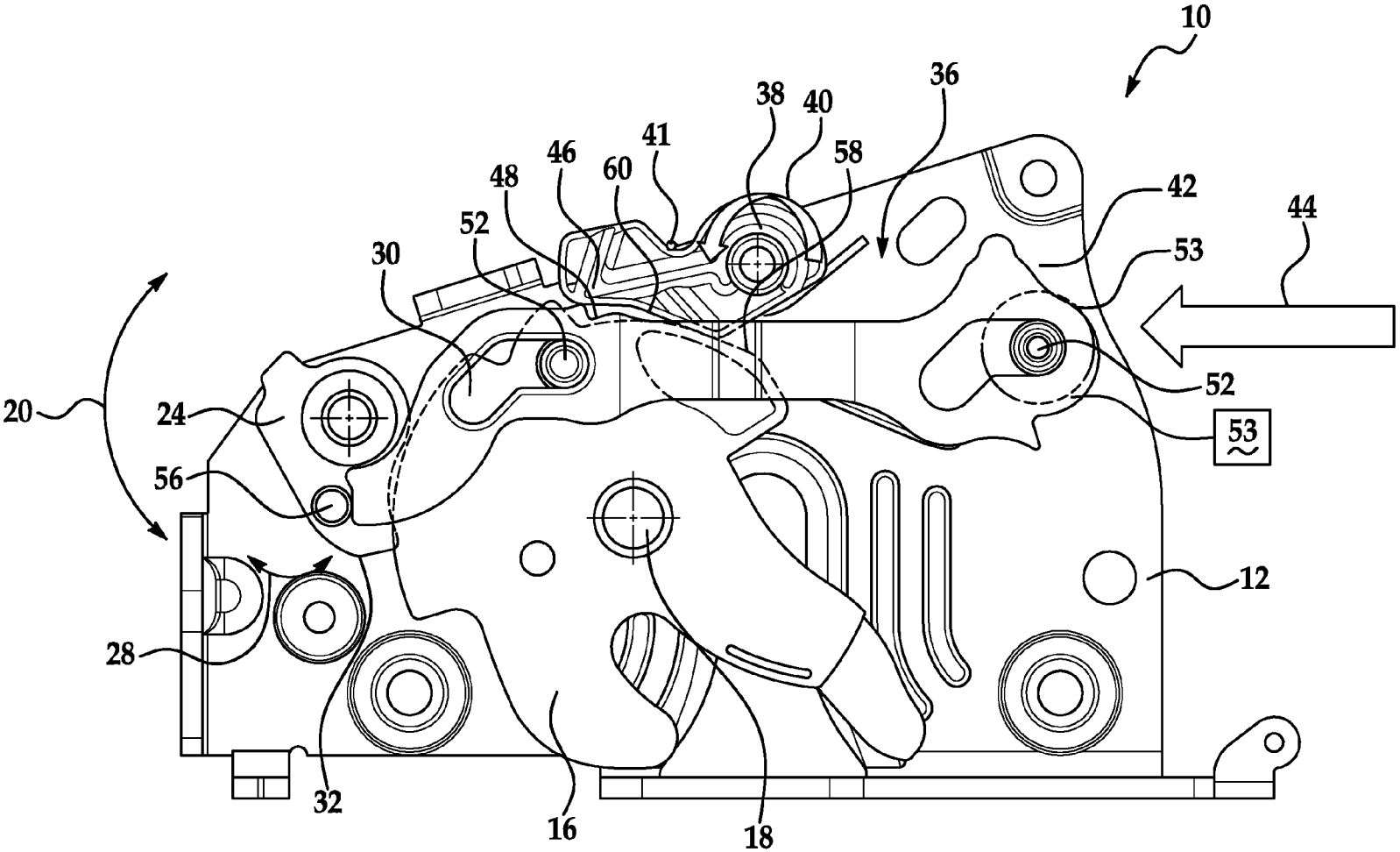
FIG. 5 is a view illustrating the latch assembly wherein the fork bolt is in the unlatched position.

As illustrated, in FIG. 5 fork bolt 16 is configured to have a cam surface or feature 58 configured to engage a complimentary surface 60 of the hold open lever and rotate the same in a direction opposite to arrow 40 such that portion 46 is no longer received within detent 48 of the slider.

Accordingly, an apparatus for preventing detent lever to engage fork bolt so that fork bolt can open when an electrically powered actuator is activated to power unlatch the door latch.

In one operation a door of the vehicle having a striker secured thereto remains closed due to fork bolt engaging the striker (e.g., latched position). Thereafter, a power unlatching mechanism moves the slider towards the detent lever to disengage it from the fork bolt (e.g., move it to the disengaged position from the engaged position) and allow free movement of the fork bolt. If however, the fork bolt is kept in the closed or primary latched position due to a condition or force being presented against the door of the vehicle, the detent lever remains in the disengaged position. This is achieved by a hold open lever that engages and retards movement of the slider after the slider has moved the detent lever into the disengaged position. In addition, the fork bolt is designed in such a way that as the door opens it will disengage the hold open lever. Allowing the power unlatching mechanism to go back into its home position such that the detent will be ready to engage the fork bolt on next closing or latching cycle.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A vehicle door latch assembly, comprising:

a fork bolt movably secured to the latch assembly, the fork bolt being capable of movement between a latched position and an unlatched position;

a detent lever movably secured to the latch assembly, the detent lever being capable of movement between an engaged position and a disengaged position, the detent lever retains the fork bolt in the latched position when the detent lever is in the engaged position and an engagement surface of the detent lever contacts an engagement surface of the fork bolt; and a remotely activated actuator for moving the detent lever into the disengaged position from the engaged position, the actuator being configured to prevent the detent lever from moving back to the engaged position until the fork bolt has been moved to the unlatched position, wherein the actuator further comprises:

a slider configured for linear movement between a first position and a second position, wherein the slider moves the detent lever into the disengaged position when the slider is in the second position; and a hold open lever rotatably secured to the latch assembly for movement between a first position wherein a portion of the hold open lever engages a feature of the slider when the slider is in the second position and a second position wherein the hold open lever does not engage the feature of the slider.

2. The vehicle door latch assembly as in claim 1, wherein the hold open lever is spring biased towards the first position.

3. The vehicle door latch assembly as in claim 1, wherein the hold open lever is moved from the first position to the second position by the fork bolt as it rotates from the latched position to the unlatched position.

4. The vehicle door latch assembly as in claim 1, wherein the slider has a pair of slotted openings configured to slidably receive a pair of pins one of which is mounted upon a surface of the fork bolt and the other which is mounted to the latch assembly remote from the fork bolt.

5. The vehicle door latch assembly as in claim 4, wherein a distal end of the slider is configured to engage a feature of the detent lever in order to rotate the detent lever into the disengaged position when the slider moves towards the second position.

6. The vehicle door latch assembly as in claim 1, wherein the fork bolt is configured to have a cam surface configured to engage a complimentary surface of the hold open lever and rotate the hold open lever from the first position towards the second position as the fork bolt moves from the latched position to the unlatched position.

7. The vehicle door latch assembly as in claim 6, wherein the hold open lever is spring biased towards the first position.

8. The vehicle door latch assembly as in claim 7, wherein the slider has a pair of slotted openings configured to slidably receive a pair of pins one of which is mounted upon a surface of the fork bolt and the other which is mounted to a surface of the latch assembly remote from the fork bolt.

9. The vehicle door latch assembly as in claim 6, wherein a distal end of the slider is configured to engage a feature of the detent lever in order to rotate the detent lever into the disengaged position as the slider moves towards the second position.

10. The vehicle door latch assembly as in claim 1, further comprising a motor configured to move the slider linearly from the first position to the second position.

11. The vehicle door latch assembly as in claim 10, wherein the slider has a pair of slotted openings configured to slidably receive a pair of pins one of which is mounted upon a surface of the fork bolt and the other which is mounted to a surface of the latch assembly remote from the fork bolt.

12. The vehicle door latch assembly as in claim 11, wherein a distal end of the slider is configured to engage a feature of the detent lever in order to rotate the detent lever into the disengaged position as the slider moves towards the second position.

13. The vehicle door latch assembly as in claim 12, wherein the fork bolt is configured to have a cam surface configured to engage a complimentary surface of the hold open lever and rotate the hold open lever from the first position to the second position as the fork bolt moves from the latched position to the unlatched position.

14. The vehicle door latch assembly as in claim 13, wherein the hold open lever is spring biased towards the first position and wherein the feature of the slider is remote from the distal end of the slider.

15. The vehicle door latch assembly as in claim 1, further comprising a motor configured to move the slider linearly from the first position towards the second position and wherein the detent lever is maintained in the disengaged position until the fork bolt is rotated to the unlatched position.

16. The vehicle door latch assembly as in claim 15, wherein the fork bolt is configured to have a cam surface configured to engage a complimentary surface of the hold open lever and rotate the hold open lever from the first position to the second position as the fork bolt moves from the latched position to the unlatched position.

* * * * *